United States Patent [19]

Huguenin

[11] 4,237,460

[45] Dec. 2, 1980

[54] ELECTRO-OPTIC DISPLAY DEVICE

[75] Inventor: Freddy Huguenin, Lausanne, Switzerland

[73] Assignee: Ebauches S.A., Canton of Neuchatel, Switzerland

[21] Appl. No.: 963,791

[22] Filed: Nov. 27, 1978

[30] Foreign Application Priority Data

Dec. 12, 1977 [CH] Switzerland ..... 15193/77

[51] Int. Cl.[3] ..... G09F 9/32

[52] U.S. Cl. ..... 340/756; 340/378.2; 340/765; 40/447; D18/26

[58] Field of Search ..... 340/756–765, 340/378.2; 40/447, 450; D18/26

[56] References Cited

U.S. PATENT DOCUMENTS

| | | | |
|---|---|---|---|
| D. 34,848 | 7/1901 | Norden | D18/26 |
| D. 228,366 | 9/1973 | Astle | D18/26 |
| 3,827,043 | 7/1974 | Maezawa | 340/756 |
| 3,831,166 | 8/1974 | DeNardo | 340/765 |
| 3,945,001 | 3/1976 | Shimakawa | 340/765 |

FOREIGN PATENT DOCUMENTS

| | | | |
|---|---|---|---|
| 261,742 | 1/1970 | U.S.S.R. | D18/26 |

*Primary Examiner*—Marshall M. Curtis

*Attorney, Agent, or Firm*—Silverman, Cass & Singer, Ltd.

[57] ABSTRACT

A seven segment display device for forming a centered number 1. Six of the segments are disposed on the sides of a quadrangular surface. Each of two long sides of the surface are provided with a pair of segments, with each of the pair of segments including a longitudinal portion lying on the long side of the surface and a transverse portion pointing toward the center of the surface. The transverse portions are arranged adjacent each other at approximately the middle of the long sides. The transverse portions of each pair of segments are extending towards but spaced from the transverse portions of the other pair of segments. Each of the short sides of the surface are provided with a segment. The seventh segment is provided on the longitudinal axis of the surface between said transverse portions.

6 Claims, 3 Drawing Figures

ELECTRO-OPTIC DISPLAY DEVICE

BACKGROUND OF THE INVENTION

The present invention relates to an electro-optic display device comprising at least one display pattern for displaying the ten digits. This pattern is formed of seven segments. Six of the segments are disposed on the sides of a quadrangular surface which is provided with two large sides each constituted by a pair of longitudinal segments situated in alignment to each other, and which is provided with two small sides constituted by two parallel transverse segments.

The drawback of these known display devices of the above mentioned type lies in the fact that the digit 1 is not centered on the quadrangular surface occupied by the digit.

The purpose of the present invention is to remove this drawback.

SUMMARY OF THE INVENTION

To this effect, the electro-optic display device according to the invention includes two pair of longitudinal segments each pair having adjacent ends which are prolonged in the direction of the middle of the display pattern and formed by two pairs of sections of transverse segments, extending towards each other, but which do not meet or touch each other. These two pairs of sections of transverse segments divide the quadrangular surface into two compartments. The seventh segment of the pattern extends from one to the other of the two compartments while passing through a free space subsisting between the pairs of sections of transverse segments prolonging the longitudinal segments.

BRIEF DESCRIPTION OF THE DRAWING

The drawing shows, by way of example, two embodiments of the invention.

DESCRIPTION OF THE PREFERRED EMBODIMENT

Figure 1:
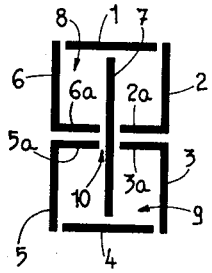
FIG. 1 is a plan view of a first embodiment of a pattern of an electro-optic display device, for instance a liquid crystal display device.

The display pattern represented in FIG. 1 comprises seven segments designated from 1 to 7, placed or formed in a rectangle.

One of the large sides of this rectangle is constituted by two longitudinal segments 2 and 3 disposed in alignment to each other, while the opposite large side is constituted by two longitudinal segments 5 and 6 also disposed in alignment to each other.

The samll sides of the rectangle are constituted by the two segments 1 and 4, which are parallel to each other and are disposed transverse of with respect to the longitudinal segments.

Segments 2 and 3, and 5 and 6 have adjacent ends which are prolonged in the direction of the middle of the pattern by transverse sections 2*a*, 3*a*, 5*a*, and 6*a*, respectively. These sections are thus distributed in two pairs, 2*a* and 3*a* on the one hand, 5*a* and 6*a* on the other hand, which extend towards each other but which do not encounter or connect with each other. The two pairs of sections of the transverse segments divide the rectangle into two compartments 8 and 9. The segment 7 constituted by a longitudinal rectilinear bar coinciding with the longitudinal axis of symmetry of the rectangle extends from one to the other of the two compartments 8 and 9 while passing through a free space 10 provided between the pairs of sections 2*a* and 3*a* on the one hand and 5*a* and 6*a* on the other hand.

Figure 2:
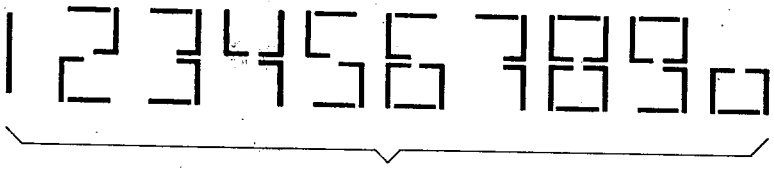
FIG. 2 shows the ten digits which can be displayed by the pattern of FIG. 1.

FIG. 2 shows, from left to right, the ten digits as they can be displayed by the pattern of FIG. 1 by means of the activation of some of the segments. As it can be seen, the digit 1, displayed by the segment 7, is centered with respect to the rectangle in which are placed the segments. This feature would be the same, of course, if this rectangle would be replaced by a parallelogram or by a trapezium.

Figure 3:
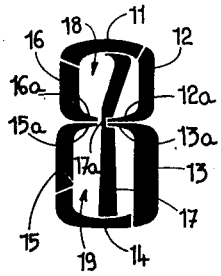
FIG. 3 is a plan view of a second embodiment of a pattern of an electro-optic display device.

In the example of FIG. 3, the pattern occupies a rectangle and is constituted by seven segments 11 to 17 corresponding respectively to the segments 1 to 7 of the first embodiment, but the shape of the segments is somewhat different. The segments 12, 13, 15 and 16 are provided with prolongations 12*a*, 13*a*, 15*a* and 16*a* which correspond respectively to the transverse segments or prolongations 2*a*, 3*a*, 5*a* and 6*a* of the first embodiment and which play the same role. Concerning the segment 17, its lower portion, situated in the compartment 19 of the pattern corresponding to the compartment 9 of the first embodiment, coincides substantially with the longitudinal axis of symmetry of the rectangle while its upper portion, disposed in the compartment 18 of the pattern corresponding to the compartment 8 of the first embodiment, extends from this axis of symmetry in the direction of the upper right angle of the pattern. Moreover, this segment 17 is provided with a central portion 17*a* which is thinner than the rest of the segment, opposite which are situated the ends of the prolongations 12*a*, 13*a*, 15*a* and 16*a* of the segments 12, 13, 15 and 16, respectively.

It is to be noted that the central portion 17*a* of the segment 17 could be made invisible, even when this segment is activated, the counter-electrode then being broken opposite this portion. The two visible portions of the segment 17 would still, however, constitute a single segment.

What I claim is:

1. A display device for displaying the ten digits, the device being substantially disposed on the sides of a quadrangular surface, the quadrangular surface having a center, a top side, a bottom side, and two longitudinal sides, the device comprising:

an upper segment lying on said top side of said quadrangular surface;

an upper-left segment including a first longitudinal portion and a first transverse portion arranged in a shape of a letter L with said first longitudinal portion lying on one of the longitudinal sides of said quadrangular surface adjacent said upper segment and said first transverse portion pointing toward said center of said quadrangular surface;

an upper-right segment including a second longitudinal portion and a second transverse portion arranged in a shape of a reversed letter L with said second longitudinal portion lying on the other of said longitudinal sides of said quadrangular surface adjacent said upper segment and said second transverse portion pointing toward said center of said quadrangular surface, said first and second transverse portions extending towards each other, but being spaced from each other;

a lower-right segment including a third longitudinal portion and a third transverse portion arranged in a shape of a number 7 with said third longitudinal portion lying on said other of said longitudinal sides of said quadrangular surface and said third transverse portion pointing toward said center of said quadrangular surface adjacent said second transverse portion;

a lower-left segment including a fourth longitudinal portion and a fourth transverse portion arranged in a shape of a reversed number 7 with said fourth longitudinal portion lying on said one longitudinal side of said quadrangular surface and said fourth transverse portion pointing toward said center of said quadrangular surface adjacent said first transverse portion, said third and fourth transverse portions extending toward each other, but being spaced from each other;

a lower segment lying on said bottom side of said quadrangular surface; and a longitudinal substantially rectilinear segment, passing through said center of said quadrangular surface in the space between said first and second transverse portions and the space between said third and foruth transverse portions and dividing said quadrangular surface into a right portion and a left portion.

2. The display device as claimed in claim 1 in which said quadrangular surface is a rectangle.

3. The display device as claimed in claim 1 in which said quadrangular surface is a parallelogram.

4. The display device claimed in claim 1 in which said quadrangular surface includes a longitudinal axis and at least a lower portion of said longitudinal substantially rectilinear segment coincides with said longitudinal axis.

5. The display device as claimed in claim 4 in which an upper portion of said longitudinal substantially recilinear segment extends from said longitudinal axis in a direction which makes an angle to the right of said longitudinal axis.

6. The display device as claimed in claim 1 in which said longitudinal substantially rectilinear segment includes a central portion thinner than the rest of said longitudinal substantially rectilinear portion adjacent said first, second, third and fourth transverse portions.

* * * * *